US006528578B2

(12) United States Patent
Wu

(10) Patent No.: US 6,528,578 B2
(45) Date of Patent: Mar. 4, 2003

(54) GOLF BALL COVERS INCLUDING POLYURETHANE AND OPTICAL BRIGHTENERS

(75) Inventor: Shenshen Wu, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/955,622

(22) Filed: Sep. 19, 2001

(65) Prior Publication Data

US 2002/0035211 A1 Mar. 21, 2002

Related U.S. Application Data

(63) Continuation-in-part of application No. 09/924,562, filed on Aug. 8, 2001, which is a division of application No. 09/812,910, filed on Mar. 20, 2001, which is a continuation of application No. 09/466,434, filed on Dec. 17, 1999, now Pat. No. 6,476,176.

(51) Int. Cl.[7] ..... A63B 37/12; C08L 75/04

(52) U.S. Cl. ..... 524/750; 524/84; 524/720; 524/742; 524/873; 473/354; 473/365; 473/374; 473/378

(58) Field of Search ..... 524/84, 742, 750, 524/873, 720; 473/354, 365, 374, 378

(56) References Cited

U.S. PATENT DOCUMENTS

| | | | | |
|---|---|---|---|---|
| 4,679,795 A | | 7/1987 | Melvin et al. | 273/235 |
| 4,865,326 A | | 9/1989 | Isaac et al. | 273/235 |
| 5,000,458 A | | 3/1991 | Proudfit | 273/235 |
| 5,018,742 A | | 5/1991 | Isaac et al. | 273/235 |
| 5,409,974 A | | 4/1995 | Sullivan et al. | 524/84 |
| 5,692,974 A | * | 12/1997 | Wu | |
| 6,054,550 A | * | 4/2000 | Umezawa | |

FOREIGN PATENT DOCUMENTS

| | | |
|---|---|---|
| WO | 96/40384 | * 12/1996 |
| WO | 99/43394 | * 9/1999 |

OTHER PUBLICATIONS

Oertel *Polyurethane Handbook* pp. 98–103, 1993.*

Chemical Abstract Registry #25973–55–1.*

* cited by examiner

*Primary Examiner*—David J. Buttner
(74) *Attorney, Agent, or Firm*—William B. Lacy

(57) ABSTRACT

A golf ball comprising a core and a cover layer wherein the cover is formed of a polyurethane composition comprising a prepolymer comprising a saturated diisocyanate and a curing agent, and an optical brightener.

28 Claims, 3 Drawing Sheets

GOLF BALL COVERS INCLUDING POLYURETHANE AND OPTICAL BRIGHTENERS

CROSS-REFERENCE TO RELATED APPLICATIONS

This application is a continuation-in-part of co-pending U.S. application Ser. No. 09/924,562, filed Aug. 8, 2001, which is a divisional of U.S. application Ser. No. 09/812,910, which was filed Mar. 20, 2001, which is a continuation of co-pending U.S. application Ser. No. 09/466,434 now U.S. Pat. No. 6,476,176, which was filed Dec. 17, 1999, all of which are incorporated herein in their entirety by express reference thereto.

FIELD OF THE INVENTION

The invention relates to golf balls and, more particularly, to golf balls having covers that comprise a polyurethane composition and an optical brightener.

BACKGROUND OF THE INVENTION

Golf ball covers are formed from a variety of materials, including balata and ionomer resins. Balata is a natural or synthetic trans-polyisoprene rubber. Balata covered balls are favored by the more highly skilled golfers because the softness of the cover allows the player to achieve spin rates sufficient to more precisely control ball direction and distance, particularly on shorter shots.

However, balata covered balls are easily damaged, and thus lack the durability required by the average golfer. Accordingly, alternative cover compositions have been developed in an attempt to provide balls with spin rates and a feel approaching those of balata covered balls, while also providing a golf ball with a higher durability and overall distance.

Ionomer resins have, to a large extent, replaced balata as a cover stock material. Chemically, ionomer resins are a copolymer of an olefin and an alpha, beta ethylenically-unsaturated carboxylic acid having 10–90% of the carboxylic acid groups neutralized by a metal ion. See U.S. Pat. No. 3,264,272. Commercially available ionomer resins include, for example, copolymers of ethylene and methacrylic or acrylic acid neutralized with metal salts. These are sold by E. I. DuPont de Nemours and Co. under the trademark SURLYN® and by the Exxon Corporation under the trademark ESCOR® and the trademark IOTEK®. These ionomer resins are distinguished by the type of metal ion, the amount of acid, and the degree of neutralization.

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls as described in the preceding patents possess virtually cutproof covers, they have inferior spin and feel properties as compared to balata covered balls.

Polyurethanes have also been recognized as useful materials for golf ball covers since as early as about 1960. U.S. Pat. No. 3,147,324, filed Oct. 20, 1960, is directed to a method of making a golf ball having a polyurethane cover. The curing agents disclosed are diamines, polyols or air moisture. The disclosed polyurethane covered golf balls are durable, while at the same time maintaining the "feel" of a balata ball.

Since 1960, various companies have investigated the usefulness of polyurethane as a golf ball cover material. U.S. Pat. No. 4,123,061 issued Oct. 31, 1978 teaches that a golf ball can be made from a polyurethane prepolymer of polyether and a curing agent, such as a trifunctional polyol, a tetrafunctional polyol or a diamine. U.S. Pat. No. 5,334,673 issued Aug. 2, 1994 discloses the use of two categories of polyurethane available on the market, i.e., thermoset and thermoplastic polyurethanes for forming golf ball covers, and in particular, thermoset polyurethane covered golf balls made from a composition of polyurethane prepolymer and a slow-reacting amine curing agent and/or a difunctional glycol.

The first commercially successful polyurethane covered golf ball was the Titleist® Professional golf ball in 1993. The principal reason for the delay in bringing polyurethane composition golf ball covers on the market was that it was a daunting engineering task to apply a covering of polyurethane composition to a golf ball core to form a golf ball cover having a uniform thickness.

In particular, the difficulty resided in centering a golf ball core in an amount of polyurethane that was sufficiently cured to keep the core centered while at the same time being insufficiently cured so that the cover material could be molded around the core. Resolution of this problem thus enabled production of the aforesaid Professional polyurethane covered golf ball to commence in 1993.

Unlike SURLYN® covered golf balls, polyurethane golf ball covers can be formulated to possess the soft "feel" of balata covered golf balls. However, golf ball covers made from polyurethane have not, to date, fully matched SURLYN® golf balls with respect to resilience or the rebound of the golf ball cover, which is a function of the initial velocity of a golf ball after impact with a golf club.

Furthermore, because the polyurethanes used to make the covers of such golf balls contain an aromatic component, e.g., an aromatic diisocyanate, polyol or polyamine, they are susceptible to discoloration upon exposure to light, particularly UV light. To slow down the discoloration, light and UV stabilizers, e.g., TINUVIN® 770, 765 and 328, are added to these aromatic polymeric materials. However, to further ensure that the covers formed from aromatic polyurethanes do not appear discolored, the covers are painted with white paint and then with a clear coat to maintain the white color of the golf ball. The application of a uniform white pigmented coat to the dimpled surface of the golf ball is a difficult process which adds time and costs to the manufacture of the golf ball. Thus, there remains a need for polyurethane materials which do not discolor and which are suitable for forming a golf ball.

SUMMARY OF THE INVENTION

The invention is directed to a golf ball including a core and a cover layer wherein the cover is formed of a polyurethane composition including of a prepolymer comprising a saturated diisocyanate and a curing agent, and an optical brightener.

The optical brightener can include stilbene derivatives; 4,4'-bis-(2-benzoxazolyl)stilbene; styryl derivatives of benzene and biphenyl; bis-(benzazol-2-yl) derivatives; thiophene benzoxazole; coumarins; 7-(2h-naphthol (1,2-d)-triazol-2-yl)-3-phenyl-coumarin; carbostyrils; naphthalimides; derivatives of dibenzothiophene-5,5-dioxide; pyrene derivatives; pyridotriazoles; derivatives of 4,4'-diamino stilbene-2,2'-disulfonic acid; 4-methyl-7-diethylamino coumarin; 2,5-bis(5-tert-butyl)-2-benzoxazolyl) thiophene; triazinol benzenedisulfonic acid derivatives; 2,2'-(1,2-ethenediylbis((3-sulfo-4,1-phenylene) imino (6-

(diethylamino)-1,3,5-triazine-4,2-diyl) imino)) bis-1,4-benzenedisulfonic acid hexasodium salt; 2,5-thiophenediylbis(5-tert-butyl-1,3-benzooxazole; and mixtures thereof, and is, preferably, 2,5-thiophenediylbis(5-tert-butyl-1,3-benzooxazole.

In one embodiment, the prepolymer further includes an initiated polycaprolactone. Preferably, the initiated polycaprolactone comprises of diethylene glycol-initiated polycaprolactone; 1,4-butanediol-initiated polycaprolactone; 1,6-hexanediol-initiated polycaprolactone; trimethylol propane-initiated polycaprolactone; neopentyl glycol-initiated polycaprolactone; polytetramethylene ether glycol-initiated polycaprolactone; and mixtures thereof.

In another embodiment, the prepolymer further includes polytetramethylene ether glycol; poly(oxypropylene) glycol; polyethylene adipate glycol; polyethylene propylene adipate glycol; polybutylene adipate glycol; polycarbonate glycol; ethylene oxide-capped polyoxypropylene diol; and mixtures thereof. Alternatively, the saturated diisocyanate includes ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate; methyl cyclohexylene diisocyanate; triisocyanate of 1,6-hexamethylene-diisocyanate; triisocyanate of 2,2,4-trimethyl-1,6-hexane diisocyanate; 4,4'-dicyclohexylmethane diisocyanate, and mixtures thereof. Preferably, the saturated diisocyanate includes 4,4'-dicyclohexylmethane diisocyanate.

In another embodiment, the curing agent includes 1,4-butanediol; isomers and mixtures of cyclohexyldimethylol; ethylene glycol; diethylene glycol; polytetramethylene ether glycol; propylene glycol; trimethanolpropane; tetra-(2-hydroxypropyl)-ethylenediamine; isomers and mixtures of cyclohexane-bis-(methylamine); triisopropanolamine; 4,4'-dicyclohexylmethane diamine; isomers and mixtures of diaminocyclohexane; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino) cyclohexane; 1,4-bis-(sec-butylamino)cyclohexane; isophorone diamine; hexamethylene diamine; propylene diamine; 1-methyl-2,4-cyclohexyl diamine; 1-methyl-2,6-cyclohexyl diamine; ethylene diamine; diethylene triamine; triethylene tetramine; tetraethylene pentamine; 1,3-diaminopropane; dimethylamino propylamine; diethylamino propylamine; imido-bis-propylamine; monoethanolamine; diethanolamine; triethanolamine; monoisopropanolamine; diisopropanolamine, and mixtures thereof. Preferably, the curing agent comprises 1,4-butanediol.

In an alternative embodiment, the polyurethane composition further includes a UV absorber including poly-(oxy-1,2-ethanediyl)-α-(3-(3-(2H-benzotriazol-2-yl)-5-(1,1-dimethylethyl)-4-hydroxyphenyl)-1-oxopropyl)-ω-hydroxy; 2-(2H-benzotriazol-2-yl)-4,6-bis-(1,1-dimethylpropyl)-phenol; dimethyl succinate polymer with 4-hydroxy-2,2,6,6-tetramethyl-1-piperidineethanol; bis-(1,2,2,6,6-pentamethyl-4-piperidinyl) sebacate; bis-(2,2,6,6-tetramethyl-4-piperidinyl) sebacate; and mixtures thereof. Preferably, the UV absorber is 2-(2H-benzotriazol-2-yl)-4,6-bis-(1,1-dimethylpropyl)-phenol.

The polyurethane composition may be thermoplastic or thermoset. The core may include a center and an outer core layer and the cover may include an inner cover layer and an outer cover layer. Alternatively, the golf ball includes a layer of tensioned elastomer material disposed between the cover and the core. In one embodiment, core includes a fluid filled, solid or hollow center.

The present invention is also directed to a golf ball including a core and a cover layer wherein the cover is formed of a polyurethane composition including a prepolymer comprising a saturated diisocyanate and a curing agent; a UV absorber; and an optical brightener.

The present invention is alternatively directed to a golf ball comprising a core and a cover layer wherein the cover comprises an inner cover layer and an outer cover layer formed of a polyurethane composition including a prepolymer comprising a saturated diisocyanate and a curing agent; a UV absorber; and an optical brightener; and wherein the inner cover layer is harder than the outer cover layer.

DESCRIPTION OF THE PREFERRED EMBODIMENTS

Figure 1:
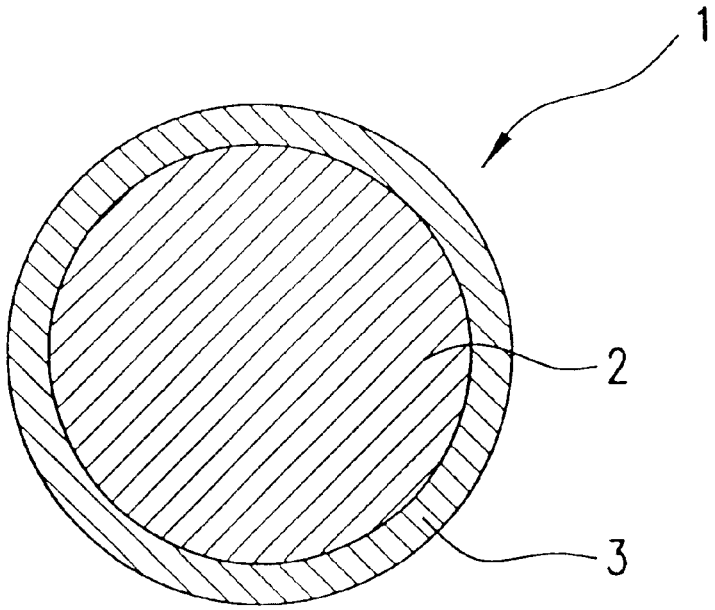
FIG. 1 is a cross-sectional view of a two-piece golf ball wherein the cover is formed from a composition comprising at least one saturated polyurethane.

Broadly, the present invention contemplates a golf ball comprising a saturated polyurethane. The ball may be a one-piece ball formed from a homogeneous mass consisting entirely of such materials, or including blends of conventional golf ball cover materials, such as those discussed hereinbelow, with a saturated polyurethane.

One-piece balls in accordance with the present invention are quite durable, but do not provide great distance because of relatively high spin and low velocity.

A more preferred aspect of the present invention comprises two-piece, multi-component and/or wound balls having cores, intermediate layers and/or covers comprising a saturated polyurethane of the type disclosed herein.

There are two main categories of castable polyurethane available on the market, i.e., thermoset and thermoplastic polyurethanes. Thermoplastic polyurethanes are linear polymers and are typically formed from the reaction of a diisocyanate and a polyol cured with a diol or a secondary diamine. Thermoset polyurethanes, on the other hand, are cross-linked polymers and are typically produced from the reaction of a diisocyanate and a polyol cured with a polyamine or polyfunctional glycol. The saturated polyurethanes used to form the golf balls of the present invention may be selected from among both castable thermoset and thermoplastic polyurethanes.

The saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, a catalyst may be employed to promote the reaction between the curing agent and the isocyanate and polyol.

Saturated diisocyanates which can be used include, without limitation, ethylene diisocyanate; propylene-1,2-diisocyanate; tetramethylene-1,4-diisocyanate; 1,6-hexamethylene-diisocyanate ("HDI"); 2,2,4-trimethylhexamethylene diisocyanate; 2,4,4-trimethylhexamethylene diisocyanate; dodecane-1,12-diisocyanate; 4-4'-dicyclohexylmethane diisocyanate ("$H_{12}$MDI"); cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate ("IPDI"); methyl cyclohexylene diisocyanate; triisocyanate of HDI; triisocyanate of 2,2,4-trimethyl-1,6-hexane diisocyanate ("TMDI"). The most preferred saturated diisocyanates are $H_{12}$MDI; and IPDI.

Saturated polyols which are appropriate for use in this invention include without limitation polyether polyols such as polytetramethylene ether glycol and poly(oxypropylene) glycol.

Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol initiated polycaprolactone, 1,4-butanediol initiated polycaprolactone, 1,6-hexanediol initiated polycaprolactone; trimethylol propane initiated polycaprolactone, neopentyl glycol initiated polycaprolactone, and polytetramethylene ether glycol (PTMEG) initiated polycaprolactone. The most preferred saturated polyols are polytetramethylene ether glycol ("PTMEG") and PTMEG initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)ethylenediamine; isomers and mixtures of isomers of cyclohexyldimethylol, isomers and mixtures of isomers of cyclohexanebis(methylamine); triisopropanolamine, ethylene diamine, diethylene triamine, triethylene tetramine, tetraethylene pentamine, 4,4'-dicyclohexylmethane diamine, 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine, hexamethylene diamine, propylene diamine, 1-methyl-2,4-cyclohexyl diamine, 1-methyl-2,6-cyclohexyl diamine, 1,3-diaminopropane, dimethylamino propylamine, diethylamino propylamine, imido-bis-propylamine, isomers and mixtures of isomers of diaminocyclohexane, monoethanolamine, diethanolamine, triethanolamine, monoisopropanolamine, and diisopropanolamine. The most preferred saturated curatives are 1,4-butanediol, 1,4-cyclohexyldimethylol and 4,4'-bis-(sec-butylamino)-dicyclohexylmethane.

Suitable catalysts include, but are not limited to bismuth catalyst, oleic acid, triethylenediamine (DABCO®-33LV), di-butyltin dilaurate (DABCO®-T12) and acetic acid. The most preferred catalyst is di-butyltin dilaurate (DABCO®-T12). DABCO® materials are manufactured by Air Products and Chemicals, Inc.

It is well known in the art that if the saturated polyurethane materials are to be blended with other thermoplastics, care must be taken in the formulation process so as to produce an end product which is thermoplastic in nature. Thermoplastic materials may be blended with other thermoplastic materials, but thermosetting materials are difficult if not impossible to blend homogeneously after the thermosetting materials are formed. Preferably, the saturated polyurethane comprises from about 1 to about 100%, more preferably from about 10 to about 75% of the cover composition and/or the intermediate layer composition. About 90 to about 10%, more preferably from about 90 to about 25% of the cover and/or the intermediate layer composition is comprised of one or more other polymers and/or other materials as described below. Such polymers include, but are not limited to polyurethane/polyurea ionomers, polyurethanes or polyureas, epoxy resins, polyethylenes, polyamides and polyesters, polycarbonates and polyacrylin. Unless otherwise stated herein, all percentages are given in percent by weight of the total composition of the golf ball layer in question.

Polyurethane prepolymers are produced by combining at least one polyol, such as a polyether, polycaprolactone, polycarbonate or a polyester, and at least one isocyanate. Thermosetting polyurethanes are obtained by curing at least one polyurethane prepolymer with a curing agent selected from a polyamine, triol or tetraol. Thermoplastic polyurethanes are obtained by curing at least one polyurethane prepolymer with a diol curing agent. The choice of the curatives is critical because some urethane elastomers that are cured with a diol and/or blends of diols do not produce urethane elastomers with the impact resistance required in a golf ball cover. Blending the polyamine curatives with diol cured urethane elastomeric formulations leads to the production of thermoset urethanes with improved impact and cut resistance.

Thermoplastic polyurethanes may be blended with suitable materials to produce a thermoplastic end product. Examples of such additional materials may include ionomers such as the SURLYN®, ESCOR® and IOTEK® copolymers described above.

Other suitable materials which may be combined with the saturated polyurethanes in forming the cover and/or intermediate layer(s) of the golf balls of the invention include ionic or non-ionic polyurethanes and polyureas, epoxy resins, polyethylenes, polyamides and polyesters. For example, the cover and/or intermediate layer may be formed from a blend of at least one saturated polyurethane and thermoplastic or thermoset ionic and non-ionic urethanes and polyurethanes, cationic urethane ionomers and urethane epoxies, ionic and non-ionic polyureas and blends thereof. Examples of suitable urethane ionomers are disclosed in U.S. Pat. No. 5,692,974 entitled "Golf Ball Covers", the disclosure of which is hereby incorporated by reference in its entirety. Other examples of suitable polyurethanes are described in U.S. Pat. No. 5,334,673. Examples of appropriate polyureas are discussed in U.S. Pat. No. 5,484,870 and examples of suitable polyurethanes cured with epoxy group containing curing agents are disclosed in U.S. Pat. No. 5,908,358, the disclosures of which are hereby incorporated herein by reference in their entirety.

A variety of conventional components can be added to the cover compositions of the present invention. These include, but are not limited to, white pigment such as $TiO_2$, ZnO, optical brighteners, surfactants, processing aids, foaming agents, density-controlling fillers, UV stabilizers and light stabilizers. Saturated polyurethanes are resistant to discoloration. However, they are not immune to deterioration in their mechanical properties upon weathering. Addition of UV absorbers and light stabilizers therefore helps to maintain the tensile strength and elongation of the saturated polyurethane elastomers. Suitable UV absorbers and light stabilizers include TINUVIN 328, TINUVIN 213, TINUVIN 765, TINUVIN 770 and TINUVIN 622. The preferred UV absorber is TINUVIN 328, and the preferred light stabilizer is TINUVIN 765. TINUVIN products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose.

In one embodiment, the polyurethane composition (saturated or unsaturated) includes optical brighteners and/or UV absorbers. Suitable optical brighteners include, but are not limited to, stilbene derivatives, such as 4,4'-bis-(2-benzoxazolyl)stilbene; styryl derivatives of benzene and biphenyl; bis-(benzazol-2-yl) derivatives, including thiophene benzoxazole; coumarins, such as 7-(2h-naphthol (1,2-d)-triazol-2-yl)-3-phenyl-coumarin; carbostyrils; naphthalimides; derivatives of dibenzothiophene-5,5-dioxide; pyrene derivatives; pyridotriazoles; derivatives of 4,4'-diamino stilbene-2,2'-disulfonic acid; 4-methyl-7-diethylamino coumarin; 2,5-bis(5-tert-butyl)-2-benzoxazolyl) thiophene; triazinol benzenedisulfonic acid derivatives, such as 2,2'-(1,2-ethenediylbis((3-sulfo-4,1-phenylene) imino (6-(diethylamino)-1,3,5-triazine-4,2-diyl) imino)) bis-1,4-benzenedisulfonic acid, hexasodium salt; and mixtures thereof. Commercially available optical brighteners are available under the tradename Uvitex® OB, which is sold by Ciba-Geigy Corporation, the chemical name for which is 2,2'-(2,5-thiophenediyl)-bis-[5-(1,1-dimethylethyl) benzoxazole]; and Eastobrite® OB-1, which is 2,2'-(1,2-ethenediyldi-4,1-phenylene) bisbenzoxazole. Optical brighteners can be present in an amount greater than about 0.01 weight percent, preferably between about 0.01 and about 2 weight percent, more preferably between about 0.01 and about 0.3 weight percent, and most preferably, between about 0.01 and about 0.05 weight percent.

Other conventional ingredients, e.g., density-controlling fillers, ceramics and glass spheres are well known to the person of ordinary skill in the art and may be included in cover and intermediate layer blends of the present invention in amounts effective to achieve their known purpose.

An optional filler component may be chosen to impart additional density to blends of the previously described components. The selection of such filler(s) is dependent upon the type of golf ball desired (i.e., one-piece, two-piece multi-component or wound), as will be more fully detailed below. Generally, the filler will be inorganic, having a density greater than about 2 g/cc, preferably greater than 4 g/cc, and will be present in amounts between 5 and 65 weight percent based on the total weight of the polymer components comprising the layer(s) in question. Examples of useful fillers include zinc oxide, barium sulfate, calcium oxide, calcium carbonate and silica, as well as the other well known corresponding salts and oxides thereof.

A representative elastomer base composition for forming a golf ball core prepared in accordance with the present invention comprises a base rubber, a crosslinking agent and a filler. The base rubber typically includes natural or synthetic rubbers. A preferred base rubber is 1,4-polybutadiene having a cis-structure of at least 40%. Natural rubber, polyisoprene rubber and/or styrene-butadiene rubber may be optionally added to the 1,4-polybutadiene. Crosslinking agents include metal salts of unsaturated fatty acids, such as zinc or magnesium salts of acrylic or methacrylic acid. The filler typically includes materials such as zinc oxide, barium sulfate, silica, calcium carbonate, metal, glass spheres and the like. The cores of golf balls formed according to the invention may be solid or hollow, fluid-filled or semi-solid filled, one-piece or multi-component cores, or they may, if desired, be wound.

The saturated polyurethanes of the invention can be used to form any type of golf ball, i.e., one-piece, two-piece, wound or multi-component. In particular, two-piece golf balls comprising a cover surrounding a core are within the scope of the present invention, as are wound golf balls, in which a fluid, semi-solid, or solid core is surrounded by a tensioned elastomeric material. The term "fluid" as used herein refers to a liquid or a gas. The term "semi-solid" as used herein refers to a paste, a gel or the like. The term "solid cores" as used herein refers not only to one piece cores but also to those cores having a separate solid layer beneath the cover and above the core as disclosed in U.S. Pat. No. 4,431,193 (the disclosure of which is incorporated herein), and other multilayer and/or non-wound cores. Any type of golf ball core can be used in the golf balls of the present invention. Preferred cores, however, include some amount of cis-polybutadiene. The subject polymers may also be used in golf balls having multiple covers and/or multiple cores.

The core compositions of the invention may be produced by blending a mixture comprising polybutadiene, zinc diacrylate, and at least one saturated polyurethane. In preparing the core blends, when a set of predetermined conditions is met, i.e., time and temperature of mixing, the free radical initiator is added in an amount dependent upon the amounts and relative ratios of the starting components, all of which would be well understood by one of ordinary skill in the art. In particular, as the components are mixed, the resultant shear causes the temperature of the mixture to rise. Peroxide(s) free radical initiator(s) are blended into the mixture for crosslinking purposes in the molding process.

After completion of the mixing, the golf ball core composition is milled and hand prepped or extruded into pieces ("preps") suitable for molding. The milled preps are then compression molded into cores at an elevated temperature. Typically, 160° C. (320° F.) for 15 minutes is suitable for this purpose. These cores can then be used to make finished golf balls by surrounding the cores with intermediate layer and/or cover materials.

One method for forming a polyurethane cover on a golf ball core is disclosed in U.S. Pat. No. 5,733,428, which method is incorporated by reference herein. This method relates to the use of thermosetting material as the golf ball cover. Other methods known to those skilled in the art may also be employed.

The present invention can be used in forming golf balls of any desired size. "The Rules of Golf" by the USGA dictates that the size of a competition golf ball be at least 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.60 to about 1.95 inches can be used. Oversize golf balls with diameters above about 1.760 inches to as big as 2.75 inches are also within the scope of the present invention.

Preferred embodiments of the balls of the invention are shown in FIGS. 1–5. In FIG. 1, the golf ball 1 comprises a core 2 of conventional materials and a cover 3 comprising at least one saturated polyurethane.

Figure 2:
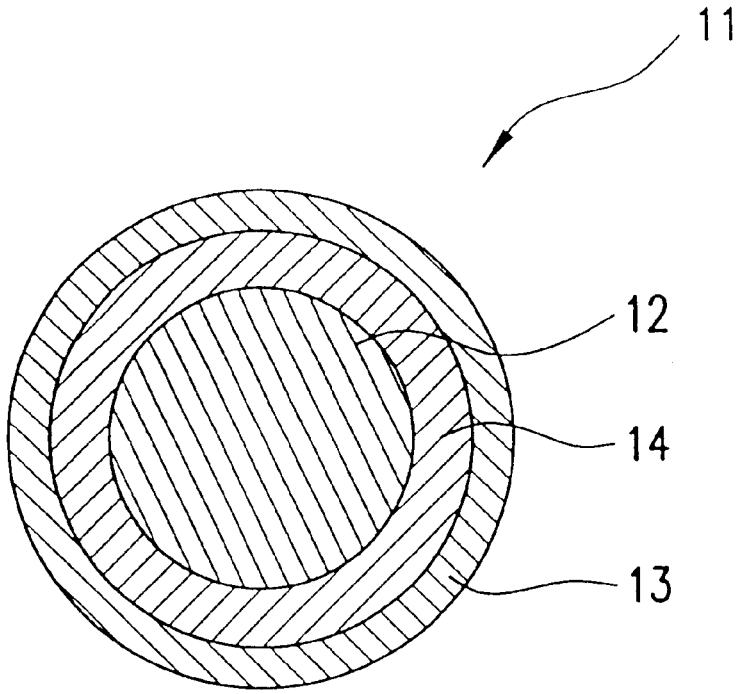
FIG. 2 is a cross-sectional view of a multi-component golf ball wherein at least one intermediate layer is formed from a composition comprising at least one saturated polyurethane.

FIG. 2 illustrates a multi-piece golf ball 11, which comprises a cover 13, at least one intermediate layer 14 and a core 12. The intermediate layer is comprised of at least one saturated polyurethane.

Figure 3:
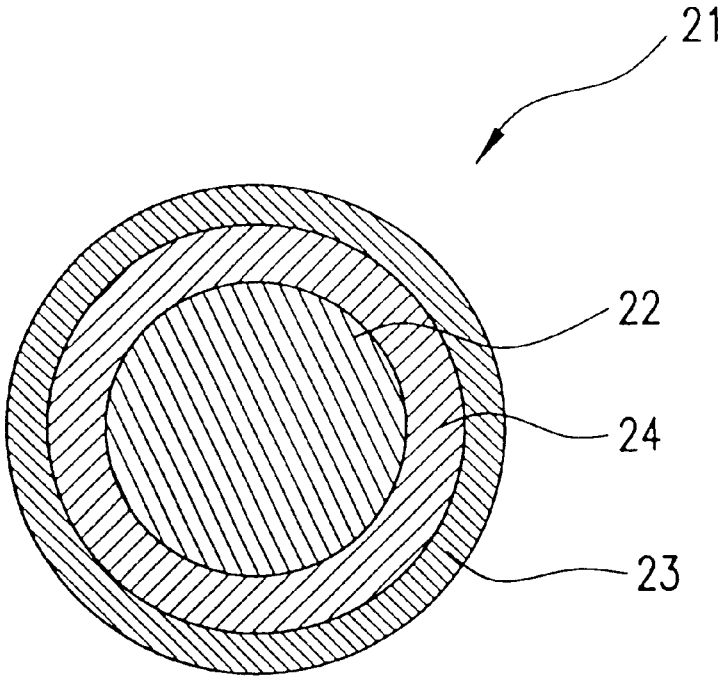
FIG. 3 is a cross-sectional view of a multi-component golf ball wherein the cover and an intermediate layer are formed from a composition comprising at least one saturated polyurethane.

The golf ball 21 of FIG. 3 has a core 22 made of conventional materials, and at least one intermediate layer 24 and cover 23 comprising at least one saturated polyurethane.

Figure 4:
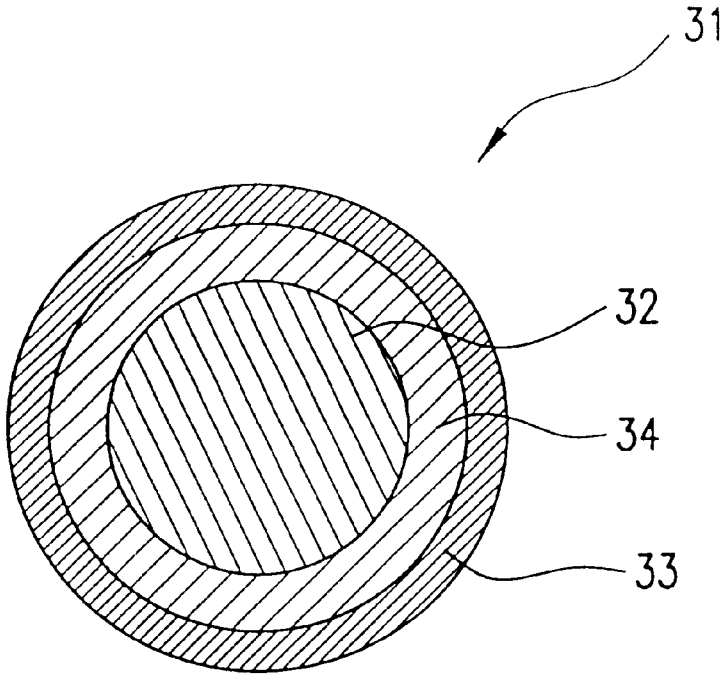
FIG. 4 is a cross-sectional view of a wound golf ball wherein the core is surrounded by a tensioned elastomeric material and the cover is formed from a composition comprising at least one saturated polyurethane.

The wound golf ball 31 of FIG. 4 has a core 32 made of conventional materials, an intermediate layer comprising a tensioned elastomeric material 34 and cover 33 comprising at least one saturated polyurethane.

Figure 5:
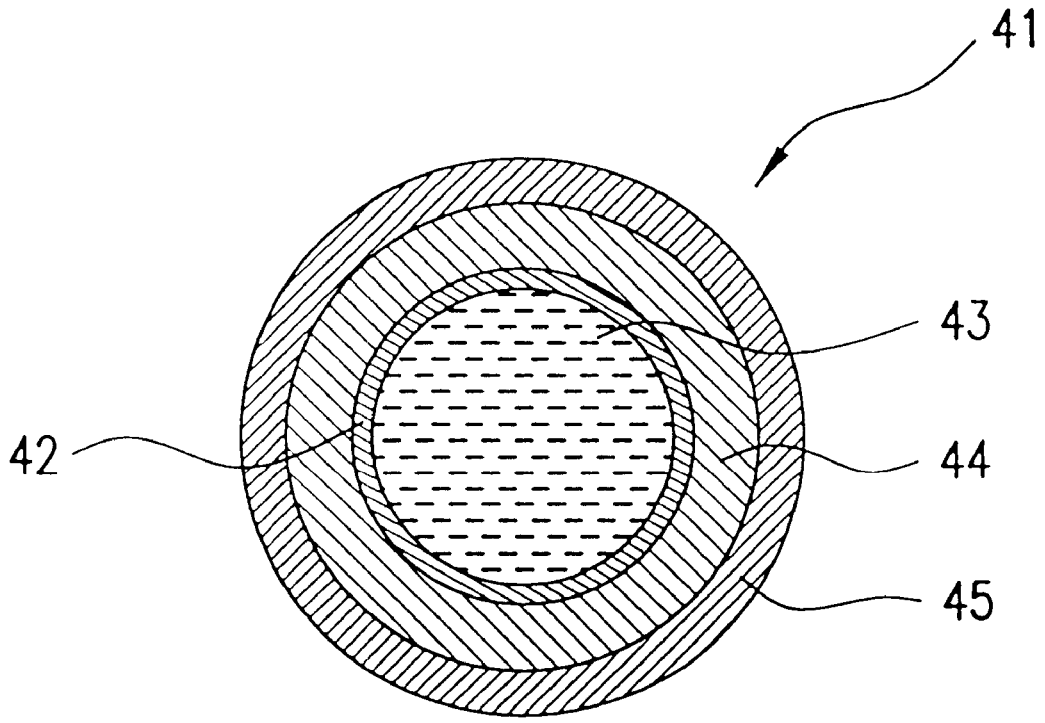
FIG. 5 is a cross-sectional view of a liquid center golf ball wherein the liquid core is surrounded by a tensioned elastomeric material and the cover is formed from a composition comprising at least one saturated polyurethane.

The wound, liquid center golf ball 41 of FIG. 5 has a hollow spherical core shell 42 with its hollow interior filled with a liquid 43, a thread rubber layer comprising a tensioned elastomeric material 44 and a cover 45 comprising at least one saturated polyurethane elastomer. The invention will now be illustrated by the following examples. The examples are not intended to be limiting of the scope of the present invention. In conjunction with the general and detailed descriptions above, the examples provide further understanding of the present invention. Parts are by weight unless otherwise indicated.

EXAMPLES

Example 1

Table I below illustrates the components used to make a first saturated polyurethane golf ball cover composition:

TABLE I

| Chemicals | Weight |
|---|---|
| IPDI Prepolymer* | 458.73 |
| 1,4-Butanediol | 42.75 |
| HCC-19584 Color Dispersion** | 17.55 |

*Prepolymer is the reaction product of isophorone diisocyanate and polytetramethylene ether glycol.
**HCC-19584 is a white-blue color dispersion manufactured by Harwick Chemical Corporation.

A golf ball was made having the cover formulated from the composition above following the teachings of U.S. Pat. No. 5,733,428 issued on Mar. 31, 1998. This ball was tested and the physical properties and the ball performance were listed in Table II.

TABLE II

| Physical Properties | Present Invention |
|---|---|
| Cover Hardness, Shore D | 68 |
| Weight, g | 45.20 |
| Compression | 103 |
| Shear Resistance | Good |
| Color Stability | Comparable to SURLYN ® |

Example 2

Table III below illustrates the components used to make a second saturated polyurethane golf ball cover composition

TABLE III

| Chemicals | Weight |
|---|---|
| HMDI Prepolymer* | 598.58 |
| 1,4-Cyclohexanedimethanol | 68.50 |
| HCC-19584 Color Dispersion | 23.35 |

*Prepolymer is the reaction product of 4,4'-dicyclohexylmethane diisocyanate and polytetramethylene ether glycol.

A golf ball was made having the cover formulated from the composition above following the teachings of U.S. Pat. No. 5,733,428 issued on Mar. 31, 1998. This ball was tested and the physical properties and the ball performance were listed in Table IV.

TABLE IV

| Physical Properties | Present Invention |
|---|---|
| Cover Hardness, Shore D | 54 |
| Weight, g | 45.48 |
| Compression | 89 |
| Shear Resistance | Good |
| Color Stability | Comparable to SURLYN ® |

The molded balls from the above composition listed in Table II are further subjected to a QUV test. The test method is described below.

ASTM G 53-88 "Standard Practice for Operating Light and Water-Exposure Apparatus (Fluorescent UV-Condensation Type) for Exposure of Nonmetallic Materials" was followed with certain modifications as described below.

Six balls of each variety under evaluation were placed in custom made golf balls holders and inserted into the sample rack of a Q-PANEL model QUV/SER Accelerated Weathering Tester manufactured by Q-Panel Lab Products of Cleveland Ohio. The sample holders were constructed such that each ball was approximately 1.75 inches from a UVA-340 bulb, at its closest point. The weathering tester was then cycled every four hours between the following two sets of conditions (for the specified total length of time, 24, 48, and 120 hours): Condition #1—water bath temperature=50° C. with the UV lamps on, set and controlled at an irradiance power of 1.00 $W/m^2/nm$. Condition #2—weather bath temperature=40° C. with the UV lamps turned off.

Color was measured before weathering and after each time cycle using a BYK-Gardner Model TCS II sphere type Spectrophotometer equipped with a 25 mm port. A D65/10° illumination was used in the specular reflectance included mode.

The test results for the molded balls after 24 hours of UV exposure are tabulated in Table V.

TABLE V

| | UV Stability Data | | | | | | | |
|---|---|---|---|---|---|---|---|---|
| Sample | ΔL* | Δa* | ΔB* | ΔC* | ΔH* | ΔE*ab | ΔW1(E313) | ΔY1(D1925) |
| Molded Present Invention | −0.21 | −0.30 | 1.54 | −1.26 | −0.94 | 1.58 | −9.07 | 2.99 |
| Molded Aromatic Polyurethane | −17.27 | 11.36 | 46.14 | 47.31 | 4.36 | 50.56 | −142.35 | 93.80 |
| Molded SURLYN | −0.39 | −0.25 | 0.91 | −0.76 | −0.55 | 1.02 | −6.19 | 1.69 |

The test results for the molded balls after 48 hours of UV exposure are tabulated in Table VI

TABLE VI

| | UV Stability Data | | | | | | | |
|---|---|---|---|---|---|---|---|---|
| Sample | ΔL* | Δa* | ΔB* | ΔC* | ΔH* | ΔE*ab | ΔW1(E313) | ΔY1(D1925) |
| Molded Present Invention | −0.48 | −0.37 | 2.54 | −2.02 | −1.59 | 2.61 | −15.16 | 4.98 |
| Molded Aromatic Polyurethane | −23.46 | 15.01 | 42.75 | 45.18 | 3.44 | 51.02 | −127.75 | 98.96 |
| Molded SURLYN | −0.54 | −0.39 | 1.43 | −1.18 | −0.91 | 1.58 | −9.50 | 2.66 |

The test results for the molded balls after 120 hour of UV exposure are tabulated in Table VII.

TABLE VII

| | UV Stability Data | | | | | | | |
|---|---|---|---|---|---|---|---|---|
| Sample | ΔL* | Δa* | ΔB* | ΔC* | ΔH* | ΔE*ab | ΔW1(E313) | ΔY1(D1925) |
| Molded Present Invention | −0.92 | −0.46 | 5.87 | −3.01 | −5.06 | 5.96 | −33.72 | 11.68 |
| Molded Aromatic Polyurethane | −30.06 | 16.80 | 33.37 | 37.29 | 2.11 | 47.95 | −107.12 | 94.42 |
| Molded SURLYN | −0.99 | −0.85 | 4.06 | −2.91 | −2.96 | 4.26 | −24.88 | 7.73 |

ΔL* = Difference in L dimension (light to dark)
Δa* = Difference in the a chroma dimension (red to green)
Δb* = Difference in the b chroma dimension (yellow to blue)
ΔC* = Combined chroma difference (a* and b* scales), hue and saturation
ΔH* = Total hue difference, excludes effects of saturation and luminescence
ΔE* = Total color difference
ΔW1 = Difference in the whiteness index
ΔY1 = Difference in the yellowness index Balls formed with the saturated polyurethane compositions of the invention typically have a Atti compression above 55, preferably between 60 and 120. As used herein, the term "Atti compression" is defined as the deflection of an object or material relative to the deflection of a calibrated spring, as measured with an Atti Compression Gauge, that is commercially available from Atti Engineering Corp. of Union City, N.J. The outer cover hardness, measured on a durometer, should be at least 40 on the Shore D scale, and preferably between about 45 and 80, while the hardness of an intermediate layer comprising the saturated polyurethane compositions should be at least 15 on the Shore A scale. The thickness of the outer cover layer should be between about 0.02 inch and 0.35 inch, while the thickness of an intermediate layer comprising the saturated polyurethane compositions should be at least 0.02 inch. The specific gravity of a cover or intermediate layer comprising the saturated polyurethane compositions should be at least 0.7. The flexural modulus of a cover or intermediate layer comprising the saturated polyurethane compositions should be at least 500 psi. The percent dimple coverage on the surface of a golf ball of the invention should be at least 60%, and preferably should be at least 70%.

All patents and patent applications cited in the foregoing text are expressly incorporated herein by reference in their entirety.

As used herein, the term "about," used in connection with one or more numbers or numerical ranges, should be understood to refer to all such numbers, including all numbers in a range.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A golf ball having a compression of at least about 55 comprising a core and a cover layer wherein the cover comprises an inner cover layer and an outer cover layer formed of a thermoset polyurethane composition comprising:

a saturated prepolymer comprising a saturated polyol and a saturated diisocyanate;

a saturated curing agent;

a UV absorber; and an optical brightener;

and wherein the inner cover layer is harder than the outer cover layer.

2. The golf ball of claim 1, wherein the optical brightener comprises stilbenes; 4,4'-bis-(2-benzoxazolyl)stilbene; styryl benzenes and styryl biphenyls; bis-(benzazol-2-yls); thiophene beozoxazole; coumarins; 7-(2h-naphthol (1,2-d)-triazol-2-yl)-3-phenyl-coumarin; carbostyrils; naphthalimides; dibenzothiophene-5,5-dioxides; pyrenes; pyridotriazoles; 4,4'-diamino stilbene-2,2'-disulfonic acids; 4-methyl-7-diethylamino coumarin; 2,5-bis(5-tert-butyl)-2-benzoxazolyl) thiophene; triazinol benzenedisulfonic acids; 2,2'-(1,2-ethenediylbis((3-sulfo-4,1-phenylene)imino (6-(diethylamino)-1,3,5-triazine-4,2-diyl)imino)) bis-1,4-benzenedisulfonic acid hexasodium salt; 2,5-thiophenediylbis(5-tert-butyl-1,3-benzooxazole; and mixtures thereof.

3. The golf ball of claim 2, wherein the optical brightener is 2,5-thiophenediylbis(5-tert-butyl-1,3-benzooxazole.

4. The golf ball of claim 1, wherein the prepolymer further comprises an initiated polycaprolactone comprising diethylene glycol-initiated polycaprolactone; 1,4-butanediol-initiated polycaprolactone; 1,6-hexanediol-initiated polycaprolactone; trirnethylol propane-initiated polycaprolactone; neopentyl glycol-initiated polycaprolactone; polytetramethylene ether glycol-initiated polycaprolactone; and mixtures thereof.

5. The golf ball of claim 1, wherein the prepolymer further comprises polytetramethylene ether glycol; poly (oxypropylene) glycol; polyethylene adipate glycol; polyethylene propylene adipate glycol; polybutylene adipate glycol; polycarbonate glycol; ethylene oxide-capped polyoxypropylene diol; and mixtures thereof.

6. The golf ball of claim 1, wherein the saturated diisocyanate comprises ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyelohexane; isophorone diisocyanate; methyl cyclohexylene diisocyanate; triisocyanate of 1,6-hexamethylene-diisocyanate; triisocyanate of 2,2,4-trimethyl-1,6-hexane diisocyanate; 4,4'-dicyclohexylmethane diisocyanate, and mixtures thereof.

7. The golf ball of claim 1, wherein the curing agent comprises 1,4-butanediol; isomers and mixtures of cyclohexyldimethylol; ethylene glycol; diethylene glycol; polytetramethylene ether glycol; propylene glycol; trimethanolpropane; tetra-(2-hydroxypropyl)-ethylenediamine; isomers and mixtures of cyclohexane-bis-(methylamine); triisopropanolamine; 4,4'-dicyclohexylmethane diamine; isomers and mixtures of diaminocyclohexane; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bisisophorone diamine; hexamethylene diamine; propylene diamine; 1-methyl-2,4-cyclohexyl diamine; 1-methyl-2,6-cyclohexyl diamine; ethylene diamine; diethylene triamine; triethylene tetramine; tetraethylene pentamine; 1,3-diaminopropane; dimethylamino propylamine; diethylamino propylamine; imido-bis-propylamine; monoethanolamine; diethanolamine; triethanolamine; monoisopropanolamine; diisopropanolamine, and mixtures thereof.

8. The golf ball of claim 1, wherein the polyurethane composition further comprises a UV absorber.

9. The golf ball of claim 8, wherein the UV absorber comprises poly-(oxy-1,2-ethanediyl),-α-(3-(3-(2H-benzotriazol-2-yl)-5-(1,1-dimethylethyl)-4-hydroxyphenyl)-1-oxopropyl)-ω-hydroxy; 2-(2H-benzotriazol-2-yl)-4,6-bis-(1,1-dimethylpropyl)-phenol; dimethyl succinate polymer with 4-hydroxy-2,2,6,6-tetramethyl-1-piperidineethanol; bis-(1,2,2,6,6-pentamethyl-4-piperidinyl) sebacate; bis-(2,2,6,6-tetramethyl-4-piperidinyl) sebacate; and mixtures thereof.

10. The golf ball of claim 1, wherein the core comprises a center and an outer core layer.

11. The golf ball of claim 1, wherein the golf ball comprises a layer of tensioned elastomer material disposed between the cover and the core.

12. The golf ball of claim 1, wherein the core comprises a fluid filled, solid or hollow center.

13. A golf ball comprising a core, a cover layer, and at least one intermediate layer disposed between the core and the cover, wherein the cover is formed of a polyurethane composition comprising:

a saturated prepolymer comprising a saturated polyol and a saturated diisocyanate;

a saturated curing agent;

an optical brightener; and a catalyst; and wherein the intermediate layer comprises a second polyurethane composition comprising a saturated polyol, a saturated diisocyanate, and a saturated curing agent.

14. The golf ball of claim 13, wherein the catalyst comprises bismuth catalyst, oleic acid, triethylenediamine, di-butyltin dilaurate, acetic acid, and mixtures thereof.

15. The golf ball of claim 13, wherein the catalyst is di-butyltin dilaurate.

16. The golf ball of claim 13, wherein the optical brightener is present in an amount of between about 0.01 and about 0.05 weight percent of the polyurethane composition.

17. The golf ball of claim 13, wherein the saturated polyol comprises polyether polyols; polyester polyols; polycarbonate polyols; polycaprolactone polyols; and mixtures thereof.

18. The golf ball of claim 13, wherein the saturated polyol comprises polytetramethylene ether glycol; polytetramethylene ether glycol initiated polycaprolactone; and mixtures thereof.

19. The golf ball of claim 13, wherein the saturated diisocyanate comprises 4,4'-dicyclohexylmethane diisocyanate, isophorone diisocyanate; or a mixture thereof.

20. The golf ball of claim 13, wherein the saturated curing agent comprises diols; triols; tetraols; secondary amines; polyamines; polyfunctional glycols; and mixtures thereof.

21. The golf ball of claim 13, wherein the polyurethane composition further comprises UV absorbers; light stabilizers; and mixtures thereof.

22. The golf ball of claim 21, wherein the UV absorbers comprise 2-(2H-benzotriazol-2-yl)-4,6-bis-(1,1-dimethylpropyl)-phenol, and wherein the light stabilizers comprise bis-(1,2,2,6,6-pentamethyl-4-piperidinyl)sebacate.

23. The golf ball of claim 13, wherein the polyurethane composition is a thermoplastic polyurethane.

24. The golf ball of claim 13, wherein the polyurethane composition is a thermoset polyurethane.

25. The golf ball of claim 13, wherein the core comprises a center and an outer core layer.

26. The golf ball of claim 13, wherein the cover comprises an inner cover layer and an outer cover layer.

27. The golf ball of claim 13, wherein the golf ball comprises a layer of tensioned elastomer material disposed between the cover and the core.

28. The golf ball of claim 13, wherein the core comprises a fluid filled, solid or hollow center.

* * * * *